US007169043B2

(12) United States Patent
Seelig et al.

(10) Patent No.: US 7,169,043 B2
(45) **Date of Patent: *Jan. 30, 2007**

(54) GAMING DISPLAY DEVICE AND METHOD OF USE

(75) Inventors: Jerald C. Seelig, Absecon, NJ (US); Lawrence M. Henshaw, Hammonton, NJ (US)

(73) Assignee: Atlantic City Coin & Slot Service Company, Inc., Pleasantville, NJ (US)

( * ) Notice: Subject to any disclaimer, the term of this patent is extended or adjusted under 35 U.S.C. 154(b) by 241 days.

This patent is subject to a terminal disclaimer.

(21) Appl. No.: 10/622,805

(22) Filed: Jul. 18, 2003

(65) Prior Publication Data

US 2004/0018871 A1 Jan. 29, 2004

Related U.S. Application Data

(63) Continuation-in-part of application No. 09/927,245, filed on Aug. 10, 2001, now Pat. No. 6,609,972.

(60) Provisional application No. 60/241,385, filed on Oct. 17, 2000.

(51) Int. Cl.
*A63F 9/24* (2006.01)

(52) U.S. Cl. ..... 463/16

(58) Field of Classification Search ..... 463/16, 463/20, 25–27, 21, 22, 30, 31, 37; 273/139, 273/143 R, 138.1
See application file for complete search history.

(56) References Cited

U.S. PATENT DOCUMENTS

| | | | | |
|---|---|---|---|---|
| 5,788,573 | A * | 8/1998 | Baerlocher et al. | 463/16 |
| 6,015,344 | A * | 1/2000 | Kelly et al. | 463/16 |
| 6,572,473 | B1 * | 6/2003 | Baerlocher | 463/20 |
| 6,609,972 | B2 * | 8/2003 | Seelig et al. | 463/16 |

* cited by examiner

*Primary Examiner*—Kim Nguyen
(74) *Attorney, Agent, or Firm*—Ian F. Burns & Associates, PC; Ian F. Burns

(57) ABSTRACT

A gaming device is provided that includes at least one game apparatus allowing a player to place a wager, play a game, and producing a bonus-activating event. The device includes at least one bonus display including a plurality of bonus prize displays and at least one selectively moveable indicator that moves relative to the bonus prize displays and indicates at least one of the bonus prize displays. Also included is at least one player input device allowing the player to stop the moveable indicator and at least one controller in communication with at least one bonus prize display. The controller detects a bonus activating event, detects the position of the moveable indicator, determines a bonus prize, and causes a bonus prize display proximate the moveable indicator to convey the bonus prize.

42 Claims, 7 Drawing Sheets

GAMING DISPLAY DEVICE AND METHOD OF USE

CROSS REFERENCE TO RELATED APPLICATIONS

This application claims priority of U.S. application Ser. No. 09/927,245 filed Aug. 10, 2001 now issued as U.S. Pat. No. 6,609,972 that, in turn, claims the priority of U.S. provisional patent application Ser. No. 60/241,385, filed Oct. 17, 2000.

BACKGROUND OF THE INVENTION

1. Field of Invention

The present invention relates to gaming devices and, more particularly, to a gaming device and method having a moving bonus indicator.

2. Background

Gaming Devices

Gaming devices are well known in the art and a large variety of gaming devices have been developed. In general, gaming devices allow users or players to play a game. In many casino-type gaming devices, the outcome of the game depends, at least in part, on a randomly generated event. For example, a gaming device may use a random number generator to generate a random or pseudo-random number (for convenience, these will both be referred to as "random numbers"). The random number may then be compared to a predefined table to determine the outcome of the event. If the random number falls within a certain range of numbers on the table, the player may win a predefined prize. The table may also contain display information that allows the gaming device to generate a display that corresponds to the outcome of the game. The gaming device may present the outcome of the game on a large variety of display devices, such as mechanical spinning reels or video screens.

Bonus Prizes

Some gaming devices award bonus prizes in addition to prizes that are awarded in the primary game. A bonus prize can be defined as an additional prize that is awarded to the player when a predefined event occurs. An example of a bonus game can be found in U.S. Pat. No. 5,848,932 issued to Adams, which is hereby incorporated by reference. One of the gaming devices described in this document comprises three spinning reels and a spinning wheel bonus display. When predetermined indicia are displayed on the spinning reels of the primary game, the wheel can be activated to indicate a bonus prize. The bonus prize is awarded in addition to any prizes awarded in the primary game.

Generally, bonus prizes are awarded in order to increase the excitement and enjoyment experienced by players, which attracts more players to the game and encourages players to play longer. When this occurs, the gaming devices tend to be more commercially successful relative to other gaming devices. A shortcoming of present bonus games is that they do not sufficiently allow players to participate in the determination of bonus prizes.

Other attempts have been made to provide player interaction. U.S. Pat. No. 5,788,573 to Baerlocher et al. (hereinafter, "Baerlocher") purports to suggest a gaming device with an electronic "wheel of fortune game." Several flippers appear to indicate positions on the wheel. Baerlocher appears to suggest that the player may be allowed to choose which flipper be used to select an indicia on the wheel. However, the player does not appear to have any control over the position of the flipper and the flippers do not appear to be capable of moving to different positions.

U.S. Pat. No. 6,309,300 to Glavich (hereinafter, "Glavich") and U.S. Pat. No. 6,439,995 to Hughs-Baird et al. (hereinafter, "Hughs-Baird") purport to suggest a gaming system having a bonus feature where a player may be allowed to select a number of selectable items, which may be prize representations, on a video display. Glavich and Hughs-Baird do not appear to suggest using prize indicators, moveable prize indicators, or allowing a player to position a prize indicator.

Display Devices

Highly visible display devices are utilized on gaming devices in order to attract players. Once players are attracted to the gaming device, they tend to play longer because the display device enhances the stimulation and excitement experienced by players. It is, therefore, desirable for gaming devices to incorporate highly visible display devices.

Display devices may be more successful if they utilize moveable physical objects rather than simulations. Although video devices and electronic signs can be used for display devices, players may be more attracted to display devices that utilize physical objects. Physical objects may be even more effective display devices if the player is allowed to participate in the operation of the object.

In view of the foregoing, there is a need in the art for a gaming device that provides bonus prizes with a physically movable and attractive bonus display, and allows selection of bonus prizes.

SUMMARY OF INVENTION

1. Advantages of the Invention

The various embodiments of the present invention may, but do not necessarily, achieve one or more of the following advantages.

provides a highly attractive and entertaining device for displaying bonus prizes;

allows players to participate in the selection of a bonus prize;

allows players to participate in the selection of a bonus prize without affecting the game outcome or any prize that may be awarded;

provides the appearance that the player has control of some part of a bonus game; and provides for random prize selection while giving the player the appearance of influencing the prize selection.

These and other advantages of the present invention may be realized by reference to the remaining portions of the specification, claims, and abstract.

2. Brief Description of at Least One Embodiment of the Invention

In one embodiment, the present invention is directed to a gaming device. The gaming device preferably includes at least one game apparatus that may allow a player to place a wager and play a game. The game apparatus is preferably configured to produce a bonus-activating event.

The gaming device also preferably includes at least one bonus display that may have a plurality of bonus prize displays and at least on moveable indicator. The indicator is preferably adapted to move relative to the bonus prize displays and selectively indicate at least one of the bonus prize displays by moving proximate the position of the indicated bonus prize display.

The gaming device preferably includes at least one player input device that allows the player to stop the moveable indicator. It is presently preferred that the gaming device include a controller that is in communication with the moveable indicator. The controller is preferably configured to detect a bonus activating event, determine a bonus prize, and cause a bonus prize display proximate the moveable indicator to convey the bonus prize.

In another embodiment, the present invention is directed to a method of operating a gaming device. A plurality of bonus prize displays are preferably provided. Each bonus prize display may be configured to display a bonus prize. A player is preferably allowed to place a wager and play a game. A player input device may be provided and a bonus activating event may be produced. Preferably, a moveable bonus indicator is provided and the player is allowed to stop the moveable bonus indicator by providing input through the player input device. It is preferred that at least one of the bonus prize displayed by indicated using the moveable bonus indicator. A bonus prize may be determined and awarded to the player.

BRIEF DESCRIPTION OF THE DRAWINGS

Preferred embodiments of the present invention are shown in the accompanying drawings wherein.

DETAILED DESCRIPTION OF AT LEAST ONE EMBODIMENT OF THE INVENTION

In the following detailed description of at least one embodiment of the invention, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
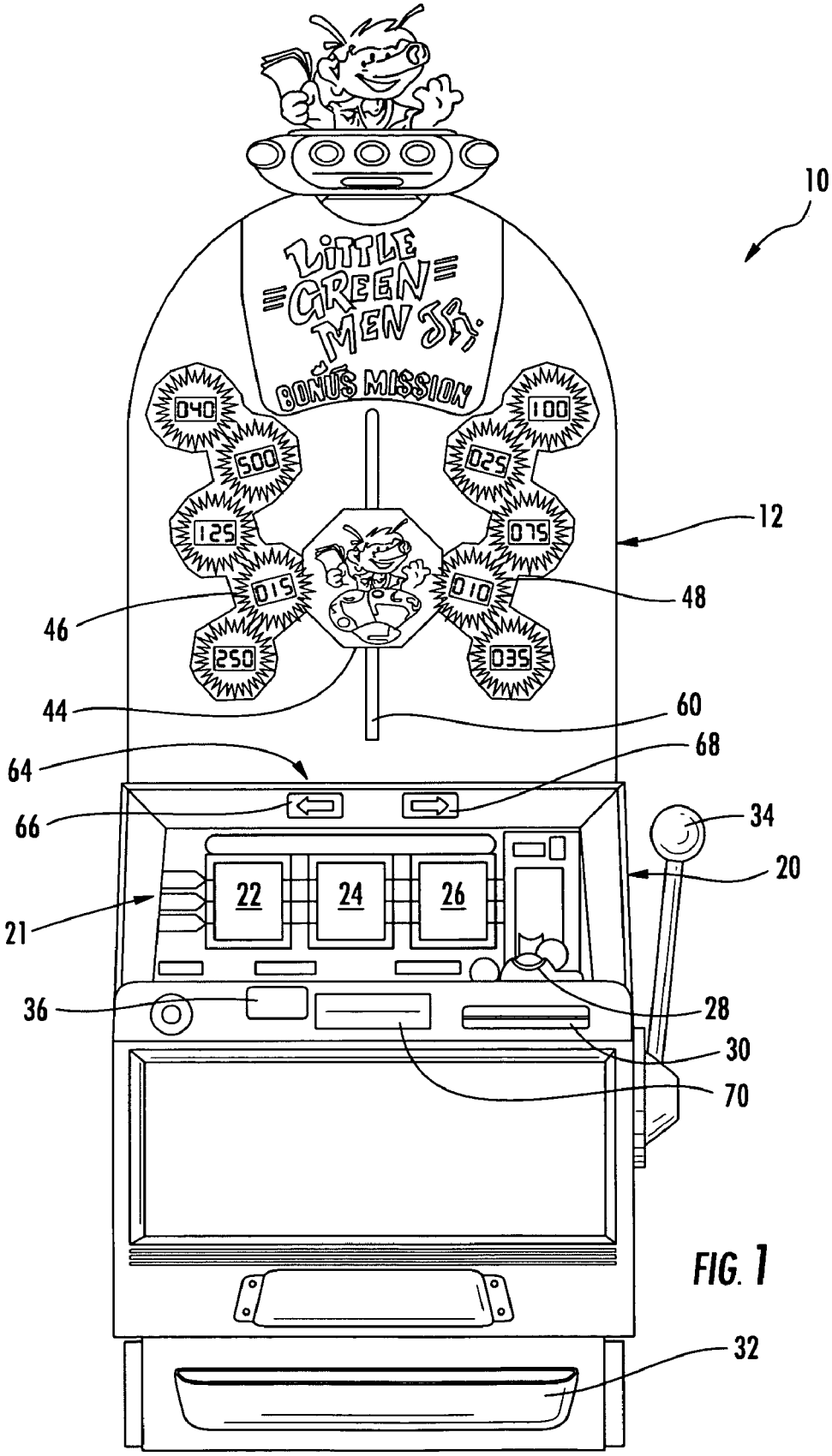
FIG. 1 is substantially a front view of a gaming device of the present invention.

As seen in FIG. 1, the present invention comprises a gaming device, generally indicated by reference number 10. In a preferred embodiment, gaming device 10 comprises a bonus display 12 and a game apparatus 20.

Game Apparatus

With continuing reference to FIG. 1, game apparatus 20 may be any of a large number of devices that are adapted to allow players to play a game. For example, game apparatus 20 may include a gaming outcome display 21 that utilizes spinning reels 22, 24, and 26 or a video display (not shown) to display outcomes of the game. A value acceptor, such as a coin slot 28 or card reader 30, may also be provided for accepting value from a player. In addition, a payout mechanism, such as a coin dispenser 32, may be provided for awarding prizes. A handle 34 and button 36 are provided for activating game apparatus 20 to begin a game. In at least one preferred embodiment, game apparatus 20 may be an S Plus model gaming device manufactured by International Game Technology in Reno, Nev.

Figure 2:
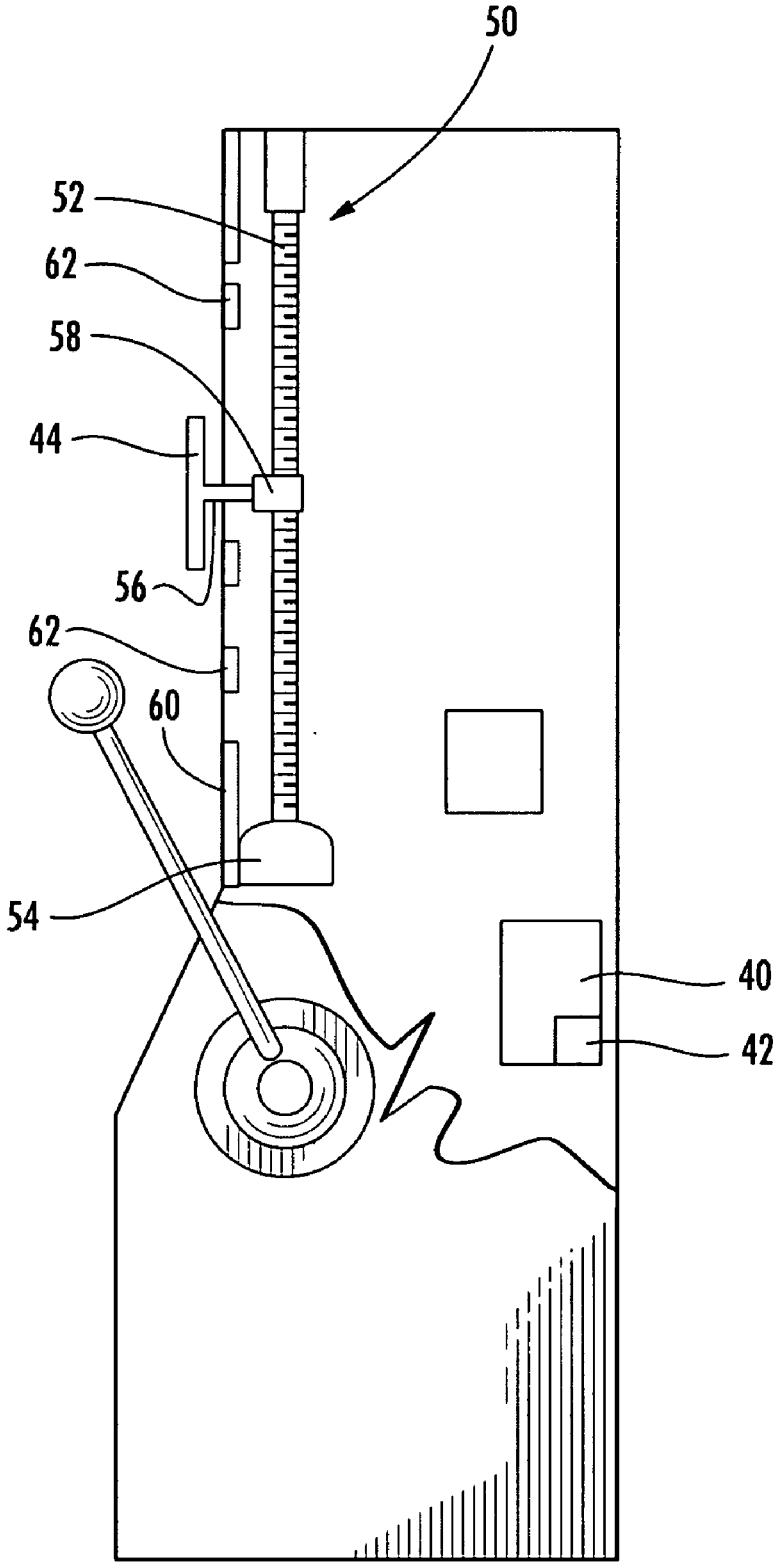
FIG. 2 is substantially a partial cross-sectional view of the gaming device of FIG. 1.

Referring also to FIG. 2, game apparatus 20 is preferably controlled by an electronic controller 40 that utilizes a random number generator 42. Random number generator 42 produces a random or pseudo random number for each game. The outcome of the game may be determined by comparing the random number to a table of outcomes stored in a memory and accessed by controller 40. A number of different tables of outcomes may be used and different tables may be used for different games. The tables can be designed so that different prizes have different probabilities of being awarded. Such design techniques are well known in gaming. Examples of such designs are shown in U.S. Pat. No. 4,448,419, issued to Telnaes, and U.S. Pat. No. 5,456,465, issued to Durham, which are hereby incorporated by reference. Controller 40 causes gaming outcome display 21 (FIG. 1), e.g., spinning reels 22, 24, and 26, to show the outcome of the game that corresponds to the outcome determined by random number generator 42. It is recognized that game apparatus 20 may operate in many other ways and still achieve the objects of the present invention.

Game apparatus 20 may also be capable, via controller 40 or another bonus control mechanism (not shown), of producing a bonus-activating event. This event may be many different types of events. For example, a bonus-activating event may comprise a game outcome, such as displaying a particular symbol, e.g., a "bonus" symbol, or combination of symbols, such as three "7" symbols on reels 22, 24, and 26. If the game being played is poker based, the bonus-activating event may be an occurrence of a certain hand, such as a royal flush. Furthermore, a bonus-activating event may occur when a player accumulates a number of symbols or game outcomes over a number of separate game plays. For example, a bonus-activating event may occur when the player receives three "bonus" symbols during a period of time. The bonus-activating event may be based on an external event. For example, a bonus-activating event may occur when a group of players obtain a certain result.

Bonus Display

Referring again to FIG. 1, bonus display 12 is adapted to select a bonus prize and display the prize to a player. When bonus display 12 is informed that a bonus-activating event has occurred, bonus display 12 causes indicator 44 to move linearly (in this case vertically) to a selected height. A plurality of stop positions (levels) are provided, and each position indicates one of a plurality of bonus sets. Each bonus set includes at least two bonus prizes, which are displayed adjacent indicator 44. In the example shown, there are five different vertical stop positions, each indicating two bonus prizes, and indicator 44 has stopped at a height that has bonus prize displays 46 and 48. Indicator 44 is illustrated as a space ship with an alien pilot and prize displays 46 and 48 appear to be planets or stars. However, many other shapes and objects may be used for indicator 44 or prize displays 46 and 48. In addition, more than one indicator may be used.

As shown in FIG. 2, indicator 44 is made to move up and down by a drive mechanism 50. The drive mechanism may be a large variety of different devices. For example, as shown in FIG. 2, drive mechanism 50 may be a vertically positioned worm gear 52 that is caused to rotate by a motor 54. Indicator 44 may be attached to worm gear 52 by a bracket 56 that is attached to a nut 58 threaded on worm gear 52. A slot 60 (best shown in FIG. 1) may be provided in the front face of bonus display 12, which allows bracket 56 to pass through the face. Sensors 62 may be provided to allow controller 40, or other bonus control mechanism (not shown), to detect the position of indicator 44. While indicator 44 was shown to move vertically, it may also be moved horizontally, or diagonally or in a non-linear fashion such as in rotating manner.

Once indicator 44 has stopped, the player is given the opportunity to select one of the prize displays. In the exemplary display shown, the user may select either the left bonus prize display 46 or the right bonus prize display 48. The player may indicate his or her choice by making a selection via one or more selectors, which may take a variety of forms. In one preferred embodiment, shown in FIG. 1, a selector 64 includes buttons 66 and 68 that allow the player to select the corresponding prize display. For example, the player would press the left button 66 to select the left bonus prize display 46. Alternatively, a touch screen (not shown) may be provided in place of or in addition to buttons 66 and 68. The selector may be any other now known or later developed mechanism for selecting between two items.

Once the player has selected the bonus prize display, bonus display 12 would display one or more bonus prizes won by the player. For instance, the selected bonus prize 46 or 48 may blink or have some other indication of selection. The indicators may light up as indicator 44 is moving.

In one preferred embodiment, the bonus prizes are randomly generated. The controller generates a random number for each bonus prize to be awarded, and then compares the random number to a pay table similar to that described for game apparatus 20 or as described in U.S. Pat. No. 5,823,874, issued to Adams, which is hereby incorporated by reference. A simple pay table may appear as follows:

| Random Number | Amount Paid |
|---|---|
| 0.00 to 0.50 | $1.00 |
| 0.51 to 0.75 | $5.00 |
| 0.76 to 0.95 | ×2 |
| 0.96 to 1.00 | $1,000.00 |

For example, if random number generator 42 produced a value of 0.65, $5.00 would be awarded to the player. If the random number generator produced a value of 0.80, the player would receive a multiplier of 2. The multiplier multiplies some amount produced by game apparatus 20. Gaming apparatus 20, for instance, may award $20 and the multiplier would multiply this by two, awarding the player $40.

The bonus selection process may be repeated to accumulate several bonus prize selections that are added to form the award to the game player. The bonus selection process can be repeated a pre-determined number of times. For example, the bonus game could be repeated three times to accumulate an award.

The present invention is not limited to the example pay table shown. Furthermore, different kinds of bonus prizes, besides monetary prizes, may be awarded. For example, the bonus prizes may be goods, services, or additional games. The bonus prize could be a jackpot prize, a progressive prize, or a prize determined by a plurality of networked gaming devices.

Once controller 40 (FIG. 2) determines the bonus prizes to be awarded, controller 40 causes the appropriate bonus prize display to display the prizes after the player has selected one of the bonus displays using input devices 66 or 68. Bonus prize displays 46 and 48 may be a large number of devices that are well known in the art. For example, the displays may be an LED meter.

Other effects may also be presented, such as pre-recorded sound from speakers. If the actual bonus prize is money, the amount of the bonus prize may be added to the player's credit meter (not shown) or the bonus prize may be dispensed from dispenser 70 or coin dispenser 32.

Many other methods may be used to operate the present invention. For example, the player may be allowed to select the vertical height of indicator 44. This function may be enabled by additional buttons or a touch screen.

Another embodiment of the invention includes a method of conducting a wagering game of chance comprising the steps of: providing a player with an opportunity to place a wager; displaying a gaming outcome at a gaming outcome display; positioning a mechanical bonus indicator at one of a plurality of physical positions to indicate a set of bonus indicators; allowing the player to select one of at least two bonus indicators; and displaying a prize on the bonus indicator selected by the player. The step of positioning the mechanical bonus indicator may include moving the bonus indicator to one of a plurality of physical positions.

Although the above embodiment has been described with reference to one gaming device 10, one gaming apparatus 20, and one bonus display 12, other configurations could be used. In particular, multiple gaming devices 10, gaming apparatus 20, and bonus displays 12 may be used with the present invention. For example, multiple gaming devices 10 could share a bonus display 12.

First Alternate Embodiment

Figure 3:
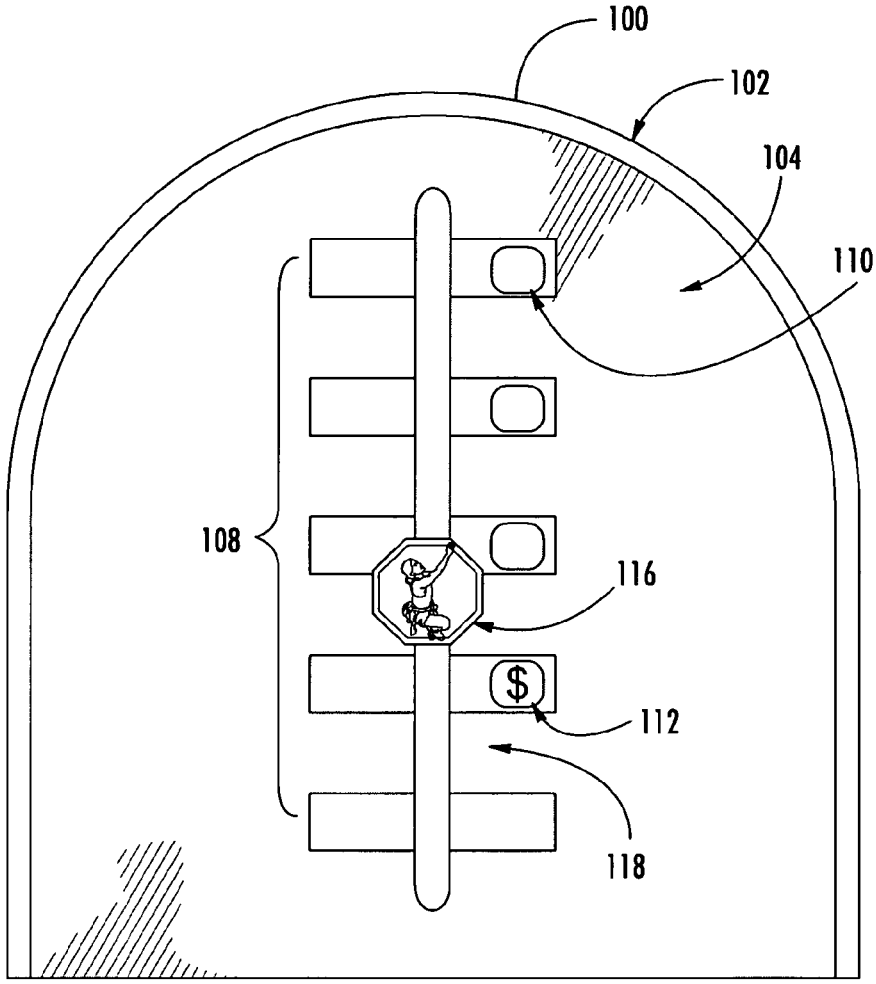
FIG. 3 is substantially a front view of an alternate embodiment of a gaming device of the present invention.

FIG. 3 depicts an alternate embodiment of the invention. Indicated generally as 100, the alternate embodiment of FIG. 3 includes a housing 102 having a display area 104. Display area 102 has prize levels 108. Prize levels 108 may be, without limitation, painted on display glass (not shown), video representations, two-dimensional cut-outs, or three dimensional objects. Prize levels 108 preferably contain a bonus prize display, such as changeable indicator 110. Changeable indicator 110 is preferably capable of displaying different prizes. For example, changeable indicator 110 may be a LED meter. Changeable indicator could also be a video or LED display capable of displaying images or different prizes to a player. Changeable indicator 110 is not limited to any particular type of indicator and those of skill in the art will be able to use all manner of changeable indicators 110 without departing from the scope of the present invention.

Display area 104 also contains a moveable prize indicator 116. In one embodiment, prize indicator 116 moves linearly on display area 104. Prize indicator 116 may be moved by any suitable actuator, such as worm gear 50 shown in FIG. 2. The actuating device may be connected to prize indicator 116 by a shaft (not shown) extending through slot 118. The actuating device is preferably in communication with a controller (such as controller 40) and a player input device (such as a button, similar to 66 and/or 68 on FIG. 1.)

Method of Operation of the First Alternate Embodiment

Figure 4:
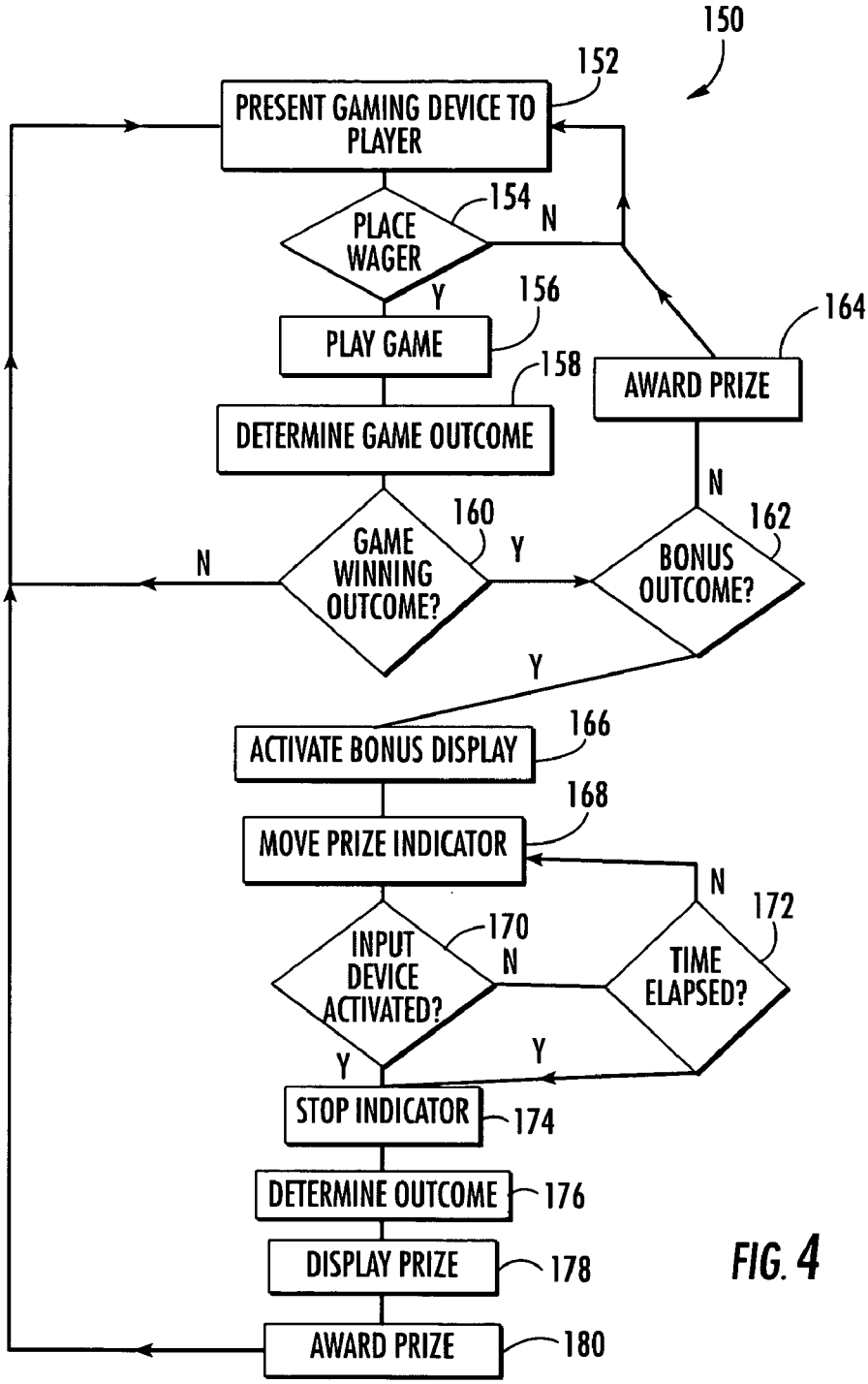
FIG. 4 is substantially a flow chart of a method of operation of the gaming device of FIG. 3.

FIG. 4 presents a flowchart illustrating one possible method of operation of the gaming device depicted in FIG. 3. The method, generally referred to as 150, begins by presenting a gaming device to a player at step 152. Decision 154 then determines if the player has placed a wager. If no wager has been placed, method 150 returns to step 152 until a wager is placed.

If a wager has been placed at decision 154, the player may activate the gaming device and play a game at step 156. The game outcome is determined at step 158. Decision 160 checks to see if the game outcome is a winning outcome.

If decision 160 determines that step 158 resulted in a losing outcome, method 150 returns to step 152. If decision 160 determines that step 158 resulted in a game winning outcome, method 150 proceeds to decision 162. Decision 162 determines whether the game outcome is a bonus activating outcome. If the game outcome from step 158 is not a bonus activating outcome, method 150 awards any prizes to which the player is entitled at step 164 and then returns to step 152.

If decision 162 determines that game outcome 158 is a bonus activating outcome, method 150 activates the bonus display at step 166, preferably enabling player input device 66, and begins to move prize indicator 116 at step 168. Prize indicator 116 may move in a variety of ways. For example, prize indicator 116 may move all the way up slot 118 and then all the way down, then back up, and so on. Alternatively, prize indicator 116 may move randomly. Prize indicator 116 may move at one or more speeds. If more than one speed is used, the speed of movement can be random, increasing, decreasing, or any pattern desired by the game developer.

Once moving prize indicator 116 has been activated, method 150 proceeds to decision 170, which ascertains whether the player has activated player input device 66. If the player has not activated player input device 66, method 150 may proceed to step 172. At step 172, method 150 checks to see if any preset time period has elapsed. For example, the game developer may limit the time prize indicator 116 is moved to thirty seconds. Once the time period elapses, prize indicator 116 will automatically stop. If this time period has not elapsed, method 150 returns to step 168 and continues movement of prize indicator 116.

If the player has activated player input device 66 at decision 170, or the time limit has expired in decision 172, method 150 proceeds to step 174. At step 174, prize indicator 116 is stopped at the nearest prize level 108. The bonus game outcome is determined at step 176 and any prize the player has won is displayed on changeable indicator 110 at step 178. The player is awarded the prize at step 180 and then method 150 returns to step 152.

Second Alternate Embodiment

Figure 5:
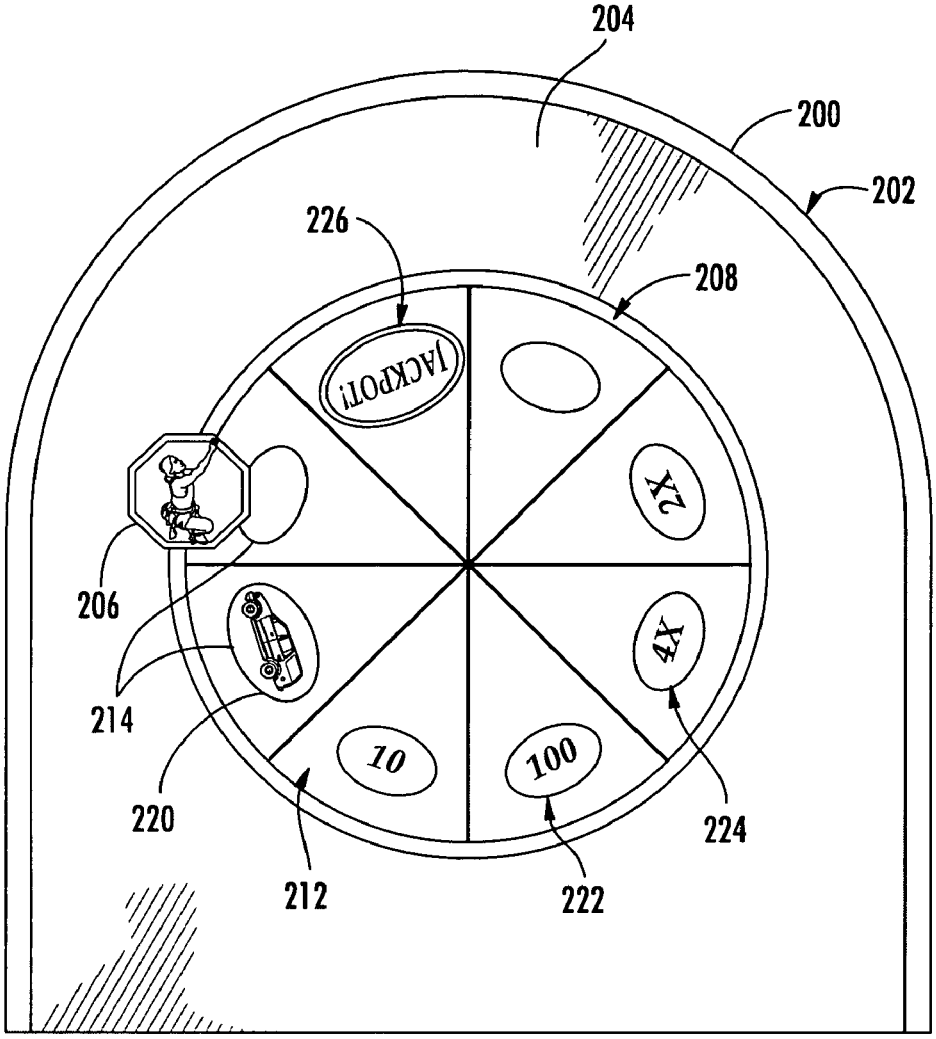
FIG. 5 is substantially a front view of an alternate embodiment of a gaming device of the present invention.

A second alternative gaming device, generally referred to as 200, is depicted in FIG. 5. Embodiment 200 has a housing 202 with a display area 204. A prize indicator 206 is preferably coupled to an actuating mechanism (or "indicator actuator", not shown in FIG. 5) through a slot 208. Prize indicator 206 is preferably moveable about display area 204. Although slot 208 is illustrated as a circle, other movement patterns could be used and still fall within the scope of the present invention. In addition, actuators not requiring a slot could be used. The indicator actuator is preferably in communication with a control (which may be controller 40). Preferably, the controller is able to control the position of prize indicator 206.

In FIG. 5, prize indicator 206 moves about a prize display 212. Prize display 212, illustrated as a circular display in FIG. 5, preferably contains a plurality of bonus prize displays 214. Bonus prize displays 214 may be fixed or changeable. Changeable bonus prize displays may be displayed using LED displays or meters. In a preferred embodiment, bonus prize displays 214 have fixed representations. Bonus prize displays 214 may represent a monetary amount 222, a bonus multiplier 224, a good or service 220 (such as a car), or a jackpot prize 226 (including networked progressive jackpot prizes). Of course other prizes may be used without departing from the scope of the present invention.

Prize display 212 may be in a fixed position or may be moveable. If moveable, prize display 212 is preferably coupled to a prize display actuator that is in communication with a controller (which may be controller 40). The controller is preferably able to control the position of prize display 212.

In a presently preferred embodiment, both prize indicator 206 and prize display 212 are moveable. Prize wheel 212 is preferably rotatable about a horizontal rotational axis. The axis may be coincident with the axis of rotation of indicator 206.

Figure 6:
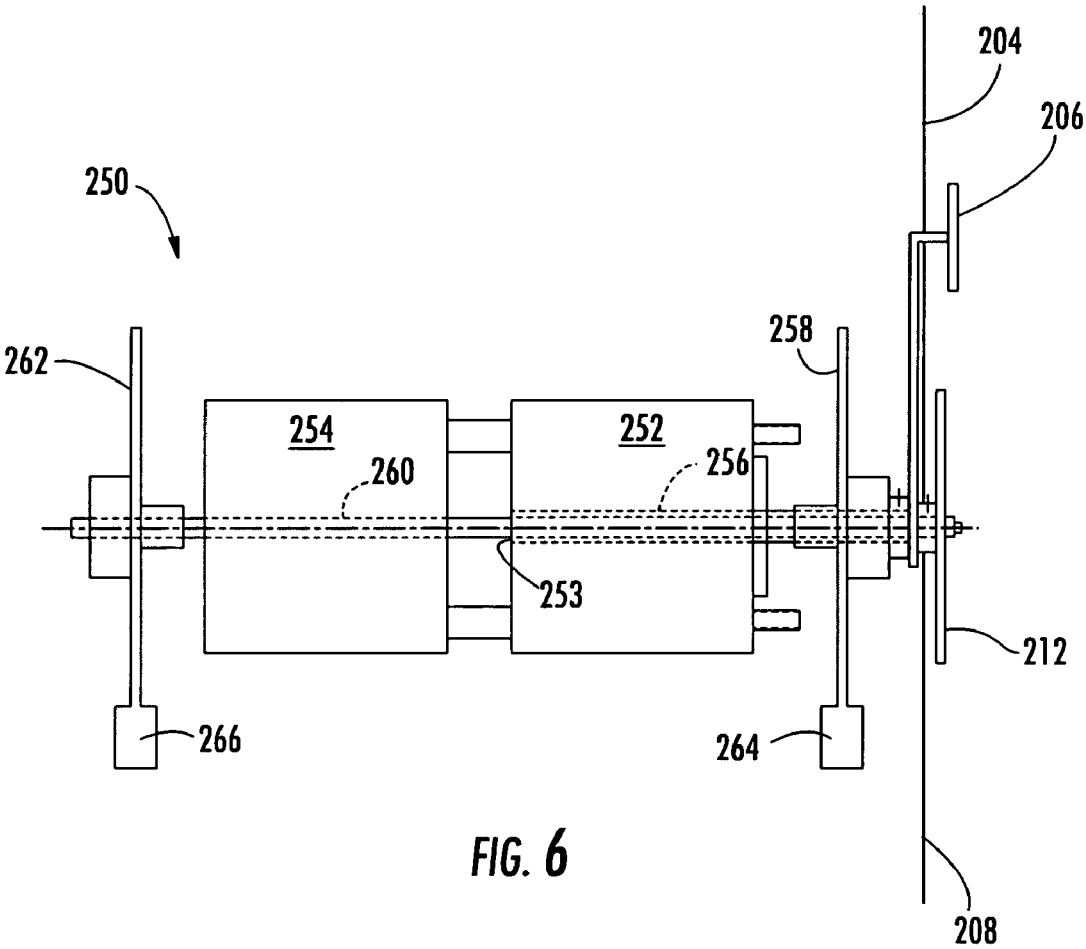
FIG. 6 is substantially a partial cross-sectional view of one embodiment of an actuator for use with the gaming device of FIG. 5.

Although the present invention is not limited to any particular type of actuator, one suitable actuator 250 is illustrated in FIG. 6. A similar mechanism is disclosed in Applicants' copending U.S. application Ser. No. 10/245,625, the disclosure of which is expressly incorporated by reference. Animation mechanism 250 may be provided for selectively positioning prize display 212 and prize indicator 206.

In a presently preferred embodiment, actuating mechanism 250 may have a first stepper motor 252 and a second stepper motor 254. First stepper motor 252 may have a tube 256 that attaches to indicator 206. Tube 256 preferably has a hollow center and is positioned within a central bore 253 of first stepper motor 252.

Second stepper motor 254 may have a shaft 260, which passes through first stepper motor 252 in tube 256 and attaches to prize display 212. Shaft 260 preferably protrudes more from first stepper motor 252 than tube 256, thereby providing space between prize display 212 and prize indicator 206. Prize display 212 and prize indicator 206 may be moved clockwise or counterclockwise and may operate independently of each other.

Animation mechanism 250 may further have at least one positioning system 258. A second positioning system 262 may be attached to end of shaft 260 opposite to the shaft end attached to prize indicator 206. The end of tube 256 opposite to the end attached to indicator 206 may be attached to first positioning system 258. First positioning system 258 and second positioning system 262 allow for tracking the position of the shafts. First positioning system 258 and second positioning system 262 may have sensors 264 and 266 that detect rotation and transmit signals that can be used to determine the angular position of indicator 206 and prize display 212. A controller (such as controller 40) may be in communication with actuating mechanism 250 to selectively position prize wheel 212 and prize indicator 206 around display 204.

Of course, other animation mechanisms, now known and latter developed, may be substituted and still fall within the scope of the present invention.

The player is preferably allowed to stop prize display 212 or prize indicator 206 using input device 66. The player may be allowed to select an exact position for prize display 212 or prize indicator 206, or the player may simply be allowed to stop prize display 212 or prize indicator 206, with the controller determining the final position. The controller preferably stops whichever of prize display 212 or prize indicator 206 is not stopped by player input device 66.

Method of Operation of the Second Alternate Embodiment

Figure 7:
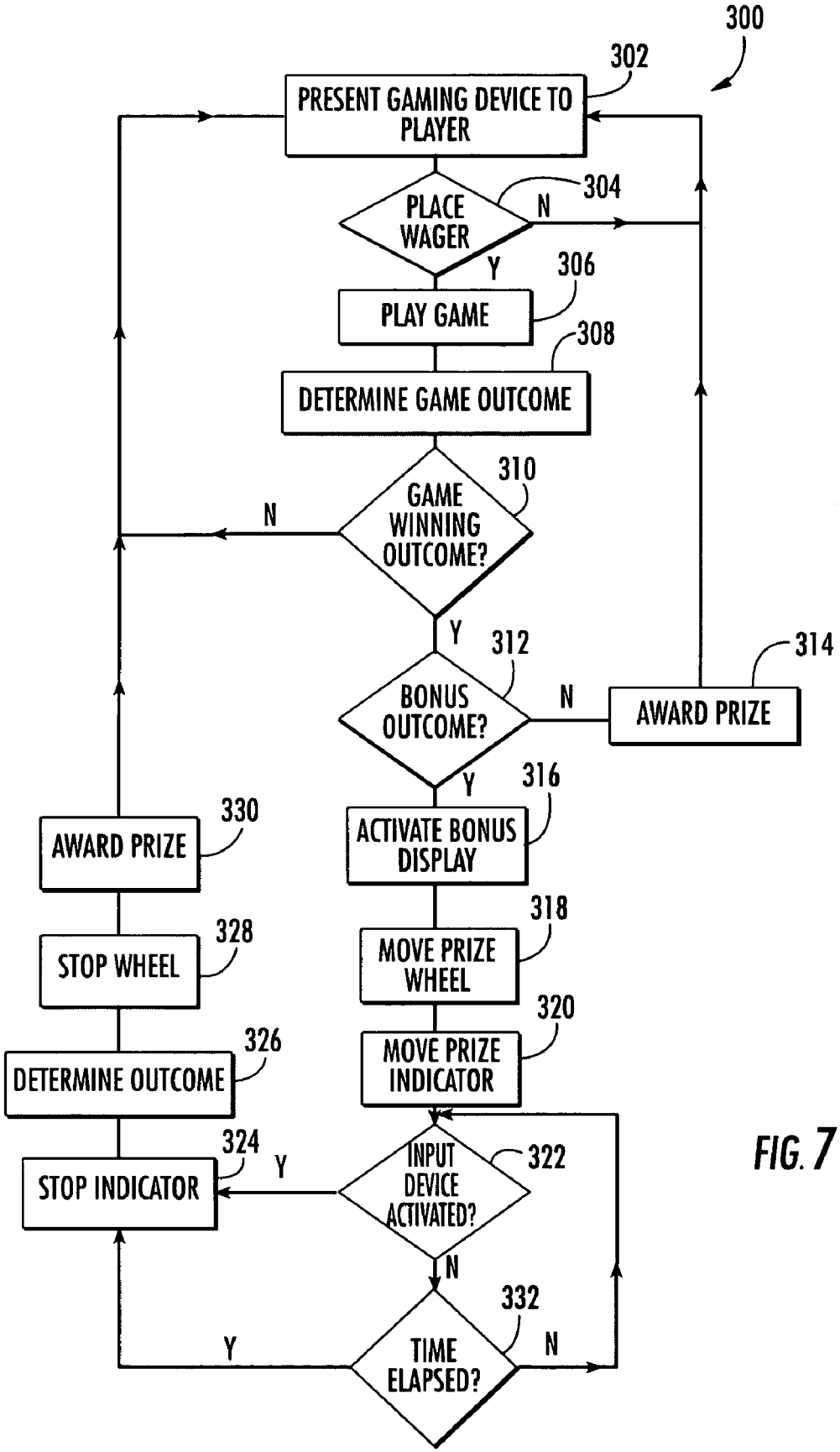
FIG. 7 is substantially a flow chart of a method of operation of the gaming device of FIG. 5.

FIG. 7 presents a flow chart of one possible method of operation of the gaming device depicted in FIG. 5. The method, generally indicated as 300, begins by presenting a game to a player at step 302. Method 300 then checks to see if the player has placed a wager at decision 304. If not, method 300 returns to step 302. If the player has placed a wager, method 300 proceeds to play a game in step 306 and determine a game outcome at step 308

At decision 310, method 300 determines whether the game outcome from step 308 was a game winning outcome. If not, method 300 returns to step 302. If step 308 resulted in a game winning outcome, method 300 proceeds to decision 312.

At decision 312, method 300 determines whether the game outcome of step 308 is an outcome that qualifies for bonus game play. If not, method 300 proceeds to step 314, awards the player any prizes the player has won, and returns to step 302. If decision 312 determines that game outcome 308 was a bonus qualifying outcome, method 300 proceeds to step 316.

At step 316, the bonus display is activated and, preferably, player input device 66 is enabled. Method 300 then proceeds to step 318 and begins to move prize wheel 212. Method 300 next moves prize indicator 206 at step 320. Method 300 then proceeds to decision 322.

At decision 322, method 300 checks to see if the player has activated player input device 66. If player input device 66 has been activated, method 300 proceeds to step 324 and stops the indicator. In one embodiment, the player is allowed to select the position of prize indicator 206 by activating player input device 66. In an alternative embodiment, the player is not able to choose the position of prize indicator 206 and activation of player input device merely directs a controller (which could be controller 40) to stop moving prize indicator 206. Of course, alternative embodiments are possible and considered within the scope of the present invention. For example, the player could be allowed to stop prize wheel 212, with a controller (which could be controller 40) stopping prize indicator 206 at the proper position to convey the game outcome.

Method 300 then determines the bonus game outcome at step 326 and stops prize wheel 212 at the corresponding position to convey the bonus game outcome in step 328. Any prize to which the player may be entitled (including prizes from the primary game) may be awarded at step 330. Method 300 then returns to step 302.

If decision 322 determines that player input device 66 has not been activated, method 300 proceeds to decision 322. Decision 322 checks to see if any pre-set time period has elapsed. If the time period has not elapsed, method 300 returns to step 322 and continues moving prize wheel 212 and prize indicator 206. If the time period has elapsed, method 300 proceeds to step 324 as discussed above.

CONCLUSION

Although the description above contains many specifications, these should not be construed as limiting the scope of the invention but as merely providing illustrations of some presently preferred embodiments of this invention. Thus, the scope of the invention should be determined by the appended claims and their legal equivalents rather than by the examples given.

What is claimed is:

1. A gaming device, the gaming device comprising:

(A) at least one game apparatus, the game apparatus allowing a player to place a wager and play a game, the game apparatus configured to produce a bonus activating event;

(B) at least one bonus display, the bonus display comprising:

(a) a plurality of bonus prize displays, (b) at least one moveable indicator, the indicator being adapted to move relative to the bonus prize displays and selectively indicate at least one of the bonus prize displays by moving proximate the position of the indicated bonus prize display;

(C) at least one player input device, the player input device allowing the player to stop the moveable indicator;

(D) at least one controller in communication with at least one of the bonus prize displays, the controller being configured to:

(a) detect the bonus activating event;

(b) detect the position of the moveable indicator;

(c) determine a bonus prize; and (d) cause a bonus prize display proximate the moveable indicator to convey the bonus prize.

2. The gaming device of claim 1 further comprising, a controller for providing random gaming outcomes.

3. The gaming device of claim 1 wherein the controller is further adapted to cause at least one of the bonus prize displays that are not proximate to the moveable indicator to display prizes.

4. The gaming device of claim 1 wherein the bonus prize displays are in a linear arrangement and the moveable indicator moves linearly.

5. The gaming device of claim 1 wherein the bonus prize displays are in a vertical arrangement.

6. The gaming device of claim 1 wherein the bonus prize displays are in a horizontal arrangement.

7. The gaming device of claim 1 wherein the bonus prize displays are in a non-linear arrangement and the moveable indicator moves non-linearly.

8. The gaming device of claim 1 wherein the controller is further configured to cause the bonus prize display proximate the position of the moveable indicator to display the bonus prize after the player has stopped the moveable indicator.

9. The gaming device of claim 8 wherein the bonus prize displays comprise at least one LED meter.

10. The gaming device of claim 1, further comprising a drive mechanism attached to the indicator, the controller being further configured to cause the drive mechanism to change the position of the indicator.

11. The gaming device of claim 10, wherein the drive mechanism comprises a worm gear and a motor, the moveable indicator being rotatably coupled to the worm gear and the motor being coupled to the worm gear, wherein the motor is configured to cause the worm gear to rotate thereby causing the indicator to move along a longitudinal axis of the worm gear.

12. The gaming device of claim 1 wherein the bonus prize displays appear on a moveable member.

13. The gaming device of claim 12 wherein the bonus prize displays comprise fixed prize indicia.

14. The gaming device of claim 12 further comprising a bonus display actuator coupled to the moveable member, the bonus display actuator in communication with the controller, wherein the controller stops the moveable member so that the bonus prize is displayed proximate the moveable indicator.

15. The gaming device of claim 14 wherein the bonus display actuator comprises a stepper motor.

16. The gaming device of claim 14, further comprising a moveable indicator actuator coupled to the indicator, wherein the indicator actuator is coupled to the indicator by a shaft, wherein the bonus display actuator is coupled to the moveable member by a shaft, wherein at least one of the bonus display actuator shaft and the indicator actuator shaft is hollow and the other shaft is located inside the hollow shaft.

17. The gaming device of claim 12 wherein the moveable member is moved after the bonus activating event and wherein the controller stops the moveable member so that the bonus prize is displayed proximate the moveable indicator, and wherein the position of the moveable indicator has no effect on the determination of the bonus prize.

18. The gaming device of claim 1 wherein the moveable indicator comprises a physical indicator.

19. The gaming device of claim 1 wherein the player may selectively position the moveable indicator.

20. A method of operating a gaming device, comprising, but not necessarily in the order shown:

(A) providing a plurality of bonus prize displays, each bonus prize display being configured to display a bonus prize;

(B) allowing a player to place a wager and play a game;

(C) producing a bonus activating event;

(D) providing a player input device;

(E) providing a moveable bonus indicator adjacent the bonus prize displays;

(E) allowing the player to stop the moveable bonus indicator by providing input through the player input device;

(E) indicating at least one of the bonus prize displays using the moveable bonus indicator;

(F) determining a bonus prize; and (H) awarding the player the bonus prize.

21. The method of claim 20 further comprising displaying the bonus prize in the bonus prize display proximate a position of the moveable bonus indicator.

22. The method of claim 20 further comprising randomly positioning the moveable bonus indicator if the player has not activated the player input device within a predetermined period.

23. The method of claim 20 wherein the bonus prize displays appear on a moveable member, further comprising:

(A) determining a particular bonus prize display to convey a bonus prize;

(B) moving the moveable member;

(C) stopping the moveable member so that the particular bonus prize display is proximate, and therefore indicated by, the bonus indicator.

24. The method of claim 23 wherein the bonus prize displays comprise fixed prize indicia, wherein the moveable member is stopped after the player has activated the player input device.

25. The method of claim 20 wherein the bonus prize displays comprise changeable displays.

26. The method of claim 20 wherein the bonus prize displays comprise fixed prize indicia.

27. The method of claim 20, wherein the bonus prize is displayed after the player activates the player input device.

28. The method of claim 20 wherein the player's activation of the player input device does not affect the determination of the bonus prize.

29. The method of claim 20, further comprising causing at least one bonus prize display that is not proximate the moveable bonus indicator to display a second bonus prize.

30. The method of claim 20 wherein the moveable bonus indicator comprises a physical indicator.

31. The method of claim 20 wherein the player may selectively position the moveable bonus indicator.

32. A gaming device, comprising:

(A) a plurality of bonus prize display means for displaying bonus prizes;

(B) indicator means for indicating at least one of the plurality of bonus prize display means, the indicator means comprising a moveable indicator;

(C) input means for allowing a player to stop the indicator means;

(D) means for causing the indicator means to move;

(E) means for determining a bonus prize;

(F) means for detecting the position of the indicator means; and (G) means for displaying the bonus prize on a bonus prize display means proximate a position of the indicator means.

33. The gaming device of claim 32 further comprising moveable display member means for moveably displaying the bonus prize display means.

34. The gaming device of claim 33 further comprising a means for moving the moveable display member means.

35. The gaming device of claim 34 further comprising means for controlling the movement of the moveable display member means.

36. The gaming device of claim 32 wherein the indicator means comprises a physical indicator.

37. A gaming system, comprising:

(A) at least one game apparatus, the game apparatus comprising:

(a) at least one gaming outcome display positioned to be visible to a player, the gaming outcome display being configured to display an outcome of a game; and (b) at least one game apparatus controller in communication with the gaming outcome display, the game apparatus controller being programmed to allow the player to play the game and cause the outcome of the game to be displayed on the gaming outcome display; and (B) at least one display device, the display device comprising:

(a) a plurality of bonus displays positioned to be visible to the player, each bonus display being configured to selectively display at least one prize;

(b) at least one moveable bonus indicator in close relative proximity to the plurality of bonus displays, the bonus indicator being configured to selectively indicate at least one of the plurality of bonus displays;

(c) at least one movement mechanism coupled to the bonus indicator, the movement mechanism being configured to cause the bonus indicator to move relative to the plurality of bonus displays;

(d) at least one selector, the selector being configured to allow the player to stop the bonus indicator; and (e) at least one display device controller in communication with each of the bonus prize displays, the movement mechanism, and the selector, the display device controller being configured to:

(i) detect when the selector has been activated by the player;

(ii) cause the movement mechanism to stop the bonus indicator when the selector is activated;

(iii) randomly determine a prize; and (iv) cause the randomly determined prize to be displayed to the player by a bonus display proximate the position of the bonus indicator.

38. The gaming system of claim 37, wherein the bonus prize display comprises an LED meter.

39. The gaming system of claim 37, wherein the prize awarded to the player is not influenced by the player activating the selector.

40. The gaming system of claim 37, the display device further comprising a moveable bonus display member, wherein the bonus displays appear on the moveable bonus display member.

41. The gaming system of claim 40 further comprising a movement mechanism coupled to the moveable bonus display member.

42. The gaming system of claim 41 wherein the moveable bonus display member movement mechanism comprises a shaft coupled to the moveable bonus display member, the bonus indicator movement mechanism comprises a shaft coupled to the bonus indicator, wherein at least one of the moveable bonus surface shaft and the bonus indicator shaft is hollow and the other shaft is located inside the hollow shaft.

* * * * *